US006349473B1

(12) United States Patent
Schmidt

(10) Patent No.: US 6,349,473 B1
(45) Date of Patent: Feb. 26, 2002

(54) UTILITY KNIFE

(75) Inventor: Kevin Schmidt, Mosinee, WI (US)

(73) Assignee: Alterra Holdings Corporation, Tigard, OR (US)

( * ) Notice: Subject to any disclaimer, the term of this patent is extended or adjusted under 35 U.S.C. 154(b) by 0 days.

(21) Appl. No.: 09/637,738

(22) Filed: Aug. 11, 2000

(51) Int. Cl.[7] ..... B26B 1/06
(52) U.S. Cl. ..... 30/162; 30/335
(58) Field of Search ..... 30/162, 335, 336, 30/163, 151

(56) References Cited

U.S. PATENT DOCUMENTS 4,858,320 A * 8/1989 Lemaire ..... 30/162
5,121,544 A * 6/1992 Gilbert ..... 30/162
5,613,300 A * 3/1997 Schmidt ..... 30/162 X
6,163,963 A * 12/2000 Huang ..... 30/162

* cited by examiner

*Primary Examiner*—Douglas D. Watts
(74) *Attorney, Agent, or Firm*—Michael D. Rechtin; Foley & Lardner

(57) ABSTRACT

A utility knife for retractably retaining a replaceable blade with a body, at least two detents connected to the body and a blade adjusting knife retaining fastener mechanism. The body has first and second portions and a major longitudinal dimension. The first and second portions define a cavity for storing at least a portion of the blade. The blade adjusting, knife retaining fastener mechanism extends through the blade adjustment slots of the first and second portions and is coupled to the blade. The fastener mechanism is configured to releasably connect the distal ends of the first and second portions of the body without the use of tools, and to releasably engage at least one of the detents and to adjustably extend along the blade adjustments slots without the use of tools. Each engagement of the fastener mechanism to one of the stops defines a distinct position of the blade with respect to the body.

20 Claims, 2 Drawing Sheets

UTILITY KNIFE

FIELD OF THE INVENTION

The present invention relates generally to the field of retractable utility knives. More particularly, the invention relates to a utility knife which integrates the blade adjustment feature with the fastener mechanism used to assemble the knife.

BACKGROUND OF THE INVENTION

Utility knives with retractable blades are well known and versatile tools which include the safety feature of enabling the blade of the knife to be retracted into the body of the knife by the user when not in use. Utility knives often include two body pieces connected together by at least one fastener. Utility knives with retractable blades typically include an actuator connected to a blade carrier. The actuator normally outwardly extends from one of the body pieces to enable a user to manipulate the actuator and thereby adjust the extension or retraction of the blade with respect to the body pieces of the knife.

Existing utility knives with replaceable blades, however, have a number of drawbacks. Utility knifes typically include at least one fastener which requires the use of a tool, such as a screwdriver, in order to remove or install the fastener and to execute replacement of the blade. Existing utility knives typically include an actuator mechanism which is separate from the fastener. Such actuator mechanisms also frequently require the use of a tool, such as a screwdriver, in order to adjust the position of the actuator, and therefore the position of the blade, with respect to the body of the utility knife. Conventional utility knives require the manipulation of the fasteners and the actuator mechanism in order to fully operate the knife. The incorporation of a separate actuator mechanism into such a utility knife increases the complexity as well as the design and manufacturing costs of the knife.

Thus, there is a continuing need for a utility knife having a blade which can be safely and easily replaced and also adjusted without the use of tools. What is needed is a utility knife which combines the actuator mechanism of the knife with the fastener of the knife in order to simplify the design and reduce the overall costs of producing the knife.

SUMMARY OF THE INVENTION

According to a principal aspect of the invention, a utility knife for retractably retaining a replaceable blade includes a body, at least two detents connected to the body and a blade adjusting, knife retaining fastener mechanism. The body has first and second portions and a major longitudinal dimension. The first and second portions each have a proximal end, a distal end and a longitudinally extending blade adjustment slot disposed between the proximal end and the distal end. The proximal end of the first portion is coupled to the proximal end of the second portion. The first and second portions define a cavity for storing at least a portion of the blade. The blade adjusting, knife retaining fastener mechanism extends through the blade adjustment slots of the first and second portions and is coupled to the blade. The fastener mechanism is configured to releasably connect the distal ends of the first and second portions of the body. The fastener mechanism is configured to releasably engage at least one of the detents and to adjustably extend along the blade adjustments slots. Each engagement of the fastener mechanism to one of the stops defines a distinct position of the blade with respect to the body.

According to another aspect of the invention, a utility knife for retractably retaining a replaceable blade includes a body, locking means coupled to the body, and blade adjusting means. The body has first and second portions and a major longitudinal dimension. The first and second portions each have a proximal end, a distal end and a longitudinally extending blade adjustment slot disposed between the proximal end and the distal end. The proximal end of the first portion is coupled to the proximal end of the second portion. The first and second portions define a cavity for storing at least a portion of the blade. The blade adjusting means extends through the blade adjustment slots of the first and second portions and is coupled to the blade. The blade adjusting means is configured to releasably engage the locking means to define at least two discrete positions of the blade with respect to the body. The blade adjusting means is configured to releasably connect the distal ends of the first and second portions of the body.

According to another aspect of the invention, a utility knife adapted to enable a user to extend and retract a replaceable blade from the knife includes first and second portions, a blade carrier, at least three detents and an adjustable fastener. The first and second portions each have a first end, an open second end and a blade adjusting slot disposed between the first and second ends. The first end of the first portion is pivotally coupled to the first end of the second portion. The first and second portions form an internal cavity. The blade carrier is disposed within the cavity. The blade carrier is adapted to retain the blade and to move along the cavity between the open and closed ends of the first and second portions. The three or more detents are connected to the first portion or the second portion. The adjustable fastener couples the open second ends of the first and second portions together. The adjustable fastener extends through the blade adjusting slots of the first and second portions. The adjustable fastener is configured to releasably engage at least one of the detents to define at least three discrete positions of the blade with respect to the body. The adjustable fastener is configured to enable the user to connect the second ends of the first and second portions without the use of tools and to enable the user to adjustably position the blade with respect to the body in at least three discrete positions without the use of tools.

Various advantages and features of the invention will be readily apparent from the following description of the preferred embodiments taken in conjunction with the accompanying drawings described below.

DETAILED DESCRIPTION OF THE PREFERRED EMBODIMENTS

Figure 1:
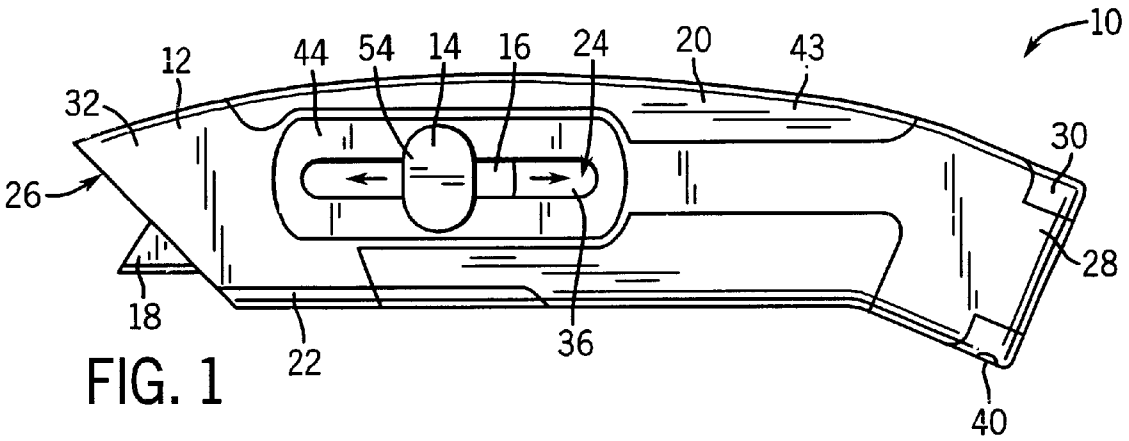
FIG. 1 is a front elevation view of the utility knife according to a preferred embodiment of the present invention.

Referring to FIG. 1, a utility knife 10 constructed in accordance with a preferred embodiment of the present invention is illustrated. The utility knife 10 generally includes a body 12, an adjustable fastener assembly 14, a blade carrier 16 and a blade 18. The body 12 is an elongate hollow member formed by a first portion 20 and a second portion 22. The body 12 has a major longitudinal dimension. When positioned in a closed position, as shown in FIG. 1, the first and second portions 20, 22 define an internal cavity 24 and a blade opening 26. The body 12 is configured to support and retain the blade carrier 16 and the blade 18 within the internal cavity 24. The blade opening 26 is sized to enable the blade 18 to extend from and retract into the internal cavity 24 of the body 12. The body 12 is preferably made of metal. Alternatively, the body 12 can be made of other materials, such as metal, plastic and wood. In a preferred embodiment, the body 12 is ergonomically contoured to fit in the hand of a user.

Figure 2:
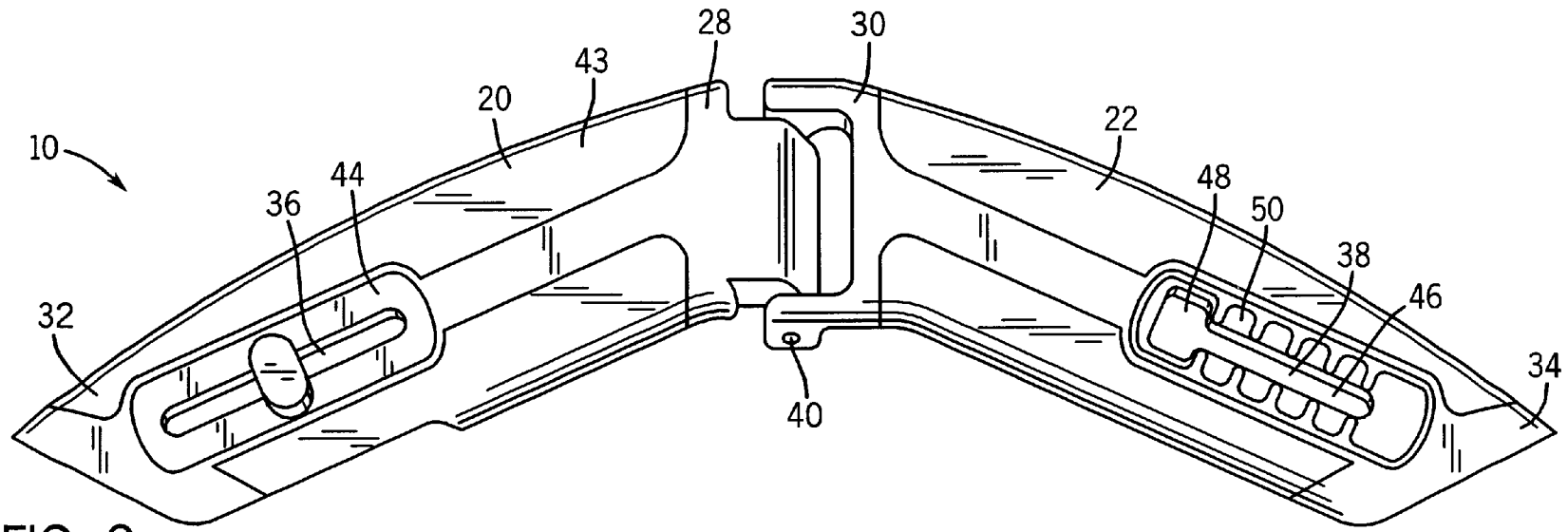
FIG. 2 is an end perspective view of the utility knife of FIG. 1 in an opened position.

The first and second portions 20, 22 of the body 12 are shown in greater detail in FIG. 2. The first and second portions are substantially corresponding mating halves of the elongate body 12. The first and second portions 20, 22 each include a proximal end 28, 30, a distal end 32, 34 and a blade adjusting slot 36, 38 defined between the proximal end 28, 30 and the distal end 32, 34, respectively. The first and second portions 20, 22 are pivotally coupled to one another at the proximal ends 28, 30 of the first and second portions 20, 22. In a preferred embodiment, the proximal ends 28, 30 of the first and second portions 20, 22 are hingeably connected through a pin 40. The first and second portions 20, 22 are positionable between a closed position and an open position. In the closed position, the adjustable fastener assembly 14 maintains the first and second portions 20, 22 in contact with one another. This feature enables the user to adjustably extend or retract the blade 18 from or into the body 12 through operation of the adjustable fastener assembly 14. In the open position, the distal ends 32, 34 of the first and second portions 20, 22 pivot about the pin 40. This enables the user to access the blade 18, the blade carrier 16 and replacement blades 42 (shown in FIG. 3). Referring again to FIG. 2, the first and second portions 20, 22 preferably include textured gripping surface 43 to facilitate grasping of the knife 10 by the user.

The blade adjusting slot 36 of the first portion 20 is a linear slot longitudinally extending along the body 12 between the proximal end 28 and the distal end 32. The first portion 20 includes a fastener recess 44 to further define the path of travel available to the fastener assembly 16 along the first portion 20. The blade adjusting slot 36 is configured to receive the fastener assembly 14. In a most preferred embodiment, the blade adjustment slot 36 of the first portion 20 corresponds to the blade adjustment slot 38 of the second portion 22, with each adjusting slot 36, 38 positioned adjacent to the distal end 32, 34 of the first and second portions 20, 22, respectively. In alternative preferred embodiments, the blade adjustment slots 36, 38 can be offset from one another.

In a preferred embodiment, the blade adjusting slot 38 of the second portion 22 is a T-shaped slot having a longitudinally extending slot segment 46 and sleeve receiving slot segment 48. The blade adjusting slot 38 is configured to receive the fastener assembly 14. The sleeve receiving slot segment 48 is defined to extend perpendicularly from the slot segment 46. The sleeve receiving slot segment 48 is configured to receive the sleeve end of the fastener assembly 14, thereby enabling the distal ends 32, 34 of the first and second portions 20, 22 to be pivoted apart from one another about the pin 40.

The second portion 22 further includes a plurality of detents 50 formed into the outer surface of the second portion 22 adjacent to the blade adjusting slot 38. The detents 50 are configured to engage the fastener assembly 14 and releasably fix the position of blade carrier 16 and the blade 18 with respect to the body 12. In a most preferred embodiment, four of the detents 50 are formed on each side of the blade adjusting slot to define four discrete positions of the blade 18 and the blade carrier 16 with respect to the body. In alternative preferred embodiments, additional or fewer detents can be formed into the body 12 of the knife 10 to define a different number of discrete blade positions.

Figure 3:
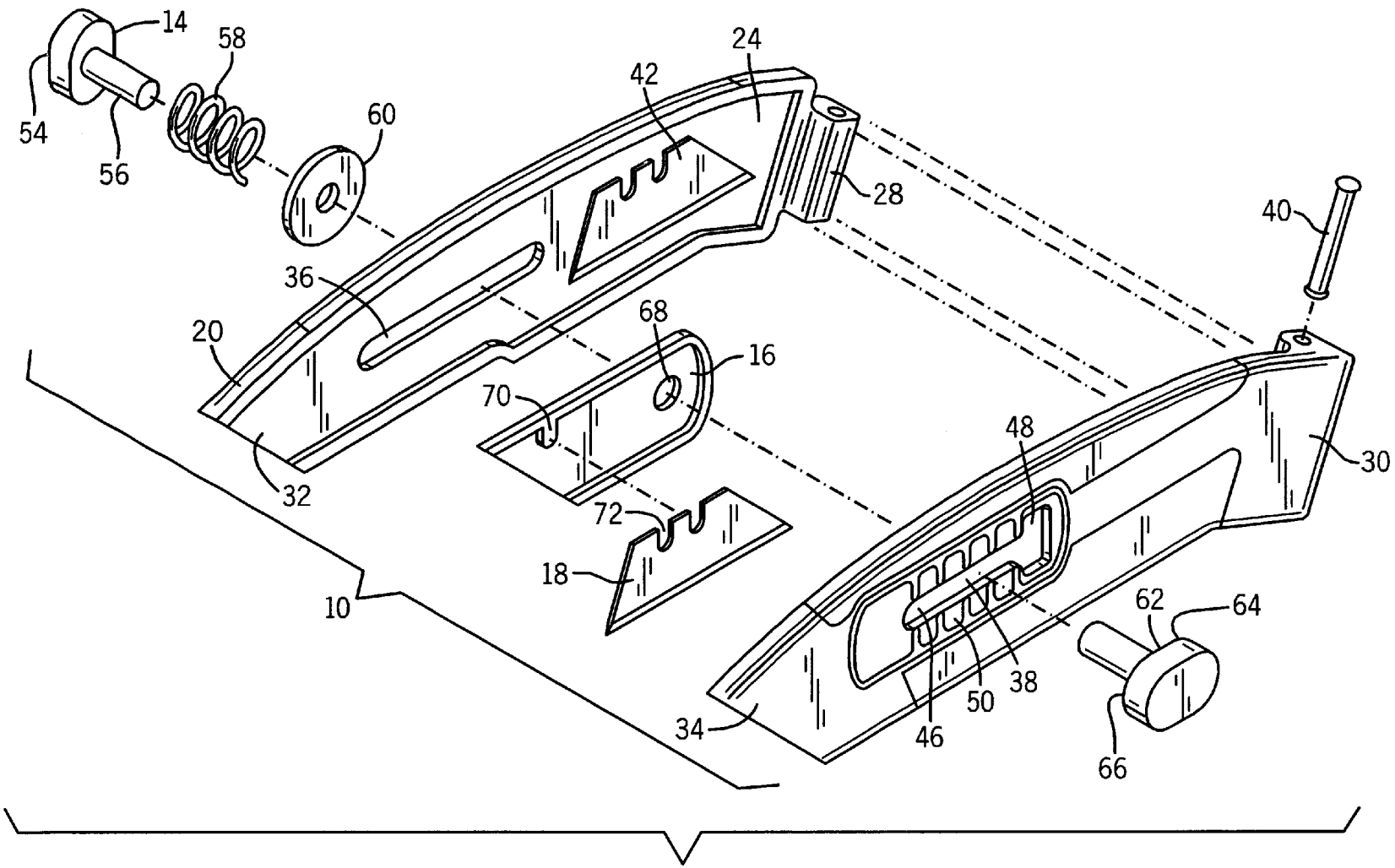
FIG. 3 is an exploded view of the utility knife of FIG. 1.

FIG. 3 illustrates the adjustable fastener assembly 14, the blade carrier 16, the blade 18 and the replacement blade 42 of the utility knife 10 in greater detail. The fastener assembly 14 is a manually adjustable and positionable fastener. The fastener assembly 14 extends through the blade adjusting slots 36, 38 of the first and second portions 20, 22 and through the blade carrier 16 to connect the distal ends 32, 34 of the first and second portions together. The fastener assembly 14 has two primary functions. The fastener assembly 14 connects and retains together the distal ends 32, 34 of the first and second portions 20, 24. The fastener assembly 14 enables the blade carrier to be releasably and adjustably engaged to the body 12 along the blade adjusting slots 36, 38 of the first and second portions 20, 22.

The fastener assembly 14 includes a knob 54, a shaft 56, a biasing member 58, a washer 60 and the sleeve 62. The knob 54 is a circular disk connected to a first end of the shaft 56. The knob 54 is configured to be easily depressed or rotated by the user to adjust the position of the blade 18 with respect to the body 12 or to place the first and second portions 20, 22 into an open position. The knob 54 is preferably made of plastic and, alternatively, can be made of rubber, metal or wood.

The shaft 56 is an elongate rod connected to the knob 54 at a first end and removably connected to the sleeve 62 at a second end. The shaft 56 extends through the biasing member 58, the washer 60, the blade adjusting slot 32 of the first portion 20 and the blade carrier 16. In a preferred embodiment, the shaft 56 includes external threads for threadedly engaging internal threads of the sleeve 62.

The biasing member 58 is preferably a coil spring but can be any other like functioning member. The biasing member 58 is disposed between the knob 54 and the washer 60 and is configured to receive the shaft 56. The biasing member 58 outwardly biases the knob 54 of the fastener assembly 14 from the outer surface of the first portion 20. When assembled, the biasing member 58 urges the sleeve 62 into engagement with one of the detents 50 on the second portion 22. In alternative preferred embodiments, the biasing member 58 can be a leaf spring, a sponge or other conventional biasing device. The biasing member 58 is sized to be overcome by the force of a user's thumb depressing the knob 54 toward the first portion 20.

The washer 60 is a conventional flat washer disposed between the biasing member 58 and the first portion 20 of the body 12. The washer 60 provides a surface for the biasing member 58 to bear against and also provides a generally smooth surface for facilitating the slidable movement of the fastener assembly 14 along the blade adjusting slot 36 of the first portion 20. The shaft 56 extends through the washer 60. Alternatively, other types of washers or spacers can be used. In yet another alternative embodiment, the fastener assembly 14 can be configured without a washer.

The sleeve 62 is a tubular fastener having outwardly extending and opposing first and second projections. The sleeve 62 adjustably connects to the shaft 56, and, in a preferred embodiment, the sleeve 62 includes internal threads for engaging the external threads of the shaft 56. The tubular portion of the sleeve 62 extends through the slot portion 46 of the blade adjusting slot 38 when the first and second portions 20, 22 of the knife 10 are in a closed position. The first and second projections are configured to releasably engage the detents 50 of the second portion 22 when the first and second portions 20, 22 of the knife 10 are in a closed position. The sleeve 62 is preferably configured to fully extend through the sleeve receiving slot segment 48 of the blade adjusting slot 38. When the sleeve 62 is aligned with the sleeve receiving slot segment 48, the first and second portions 20, 22 are free to pivot about the pin 40 at the proximal ends 28, 30 of the first and second portions, respectively. The configuration of the sleeve 64 and the slot segment 48 enables the first and second portions 20, 22 of the body 12 of the knife 10 to be easily opened for replacing the blade 18 without the use of tools and without separating the fastener assembly 14. This enables the knife 10 to be easily, efficiently and quickly opened without disconnecting the fastener assembly 14 and without dislodging the blade carrier 16 from the fastener assembly 14. Thus, when the fastener assembly 14 is positioned within the sleeve receiving slot portion 48, the knife 10 can be opened with only the replaceable blade 18 and the stored replacement blade 42 available for removal or replacement. Moreover, the fastener assembly 14 eliminates the need for having one component for connecting the two portions of the body 12 of the knife 10 together and a separate component for actuating the blade 18 with respect to the body 12 of the knife 10.

The blade carrier 16 is a support member disposed between the first and second portions 20, 22 of the body 12. The blade carrier 16 includes an opening 68 for receiving the fastener assembly 14 and a blade tab 70 for aligning the blade 18 onto the blade carrier 16. The blade carrier 16 is configured to receive and to support the blade 18. The blade carrier 16 is slidably and adjustably movable between the first and second portions 20, 22 in order to move the blade 18 from a fully extended position to a fully retracted position. The blade carrier 16 guides the blade 18 through the inner cavity 24 of the body 12 and out through the blade opening 26 of the body 12. The blade carrier 18 is preferably made of plastic and, alternatively, can be made of other materials, such as metal or wood.

The blade 18 is a conventional blade, preferably trapezoidal in shape, and includes two notches 72 in its top edge. The tab 70 extends from the top wall of the blade carrier 16 and is configured to engage one of the notches 72. The engagement of the notch 72 with the tab 70 enables the blade carrier 16 to positively retain the blade 18. The blade 18 moves forwardly or rearwardly with the slidable movement of the blade carrier 16. The blade carrier 16 and the blade 18 are configured to enable a user, when the first and second portions 20, 22 of the body 12 are in an open position, to easily and quickly reposition the blade 18 or replace the blade 18 from the carrier 16 without requiring disassembly of the fastener assembly 14 and without the use of tools. The blade 18 is preferably made of steel and, alternatively, can be made of other metals.

The inner cavity 24 of the body 12 is configured to safely store replacement blades 42. The replacement blades 42 are positioned between the first and second portions 20, 22 near the proximal ends 28, 30 of the first and second portions 20, 22.

In operation, when the first and second portions 20, 22 of the body 12 of the knife 10 are in a closed position, the user grasps the knife 10 with one hand and adjustably positions the fastener assembly 14 to extend or retract the blade 18 to the desired position with respect to the body 12 of the knife 10. The user performs the repositioning of the blade 18 with respect to the body 12 by grasping the knife with one hand and using the thumb of that hand to depress and hold the knob 54 of the fastener assembly. When the knob 54 is depressed the biasing member 58 is compressed and the shaft 56 extends further through the body 12 of the knife 10 in the direction of the sleeve 62. In response to this movement, the sleeve 62 outwardly extends from the outer surface of the second portion 22 and is released from engagement with one of the detents 50. Once released from engagement with the detents 50, the user can slidably move the fastener assembly toward the distal or proximal ends of the knife 10 and along the blade adjusting slots 36, 38 of the first and second portions 20, 22. When the desired amount of extension or retraction of the blade 18 with respect to the body 12 is obtained, the user releases pressure from the knob 54 of the fastener assembly. The biasing member 58 then outwardly extends the knob 54 away from the outer surface of the first portion 20 of the body 12, thereby causing the sleeve 62 to move inwardly toward the outer surface of the second portion 22 and to engage one of the detents 50.

When the user desires to open the first and second portions 20, 22 of the knife 12 in order to reposition or replace the blade, or to generally inspect the knife 10, the user fully depresses the knob 54 and moves the fastener mechanism 14 toward the proximal end of the body 12 until the sleeve 62 of the fastener mechanism 14 is aligned with the sleeve receiving slot segment 48 of the blade adjusting slot 38. Depending on the amount of threaded engagement between the shaft 56 and the sleeve 62, the user may have to partially unthread the shaft 56 from the sleeve 62 in order to increase the total length of the fastener assembly 14 and to facilitate the positioning of the fastener assembly 14 over the slot segment 48 when the knob 54 is fully depressed. Once aligned with the slot segment 48, the user pivots the first and second portions 20, 22 about the pin 40 and gains access to the internal cavity 24 of the knife 10. The user, therefore, gains access to the internal cavity 24 of the knife 10 without having to use tools and without having to separate the fastener assembly 14, the blade carrier 16 or any other component of the knife 10. The fastener assembly 14 therefore, functions to maintain the first and second portions 20, 22 of the body 12 of the knife 10 in a closed position and also functions as the actuator for adjustably positioning the blade 18 with respect to the body 12.

While a preferred embodiment of the present invention has been described and illustrated, numerous departures therefrom can be contemplated by persons skilled in the art, for example, the utility knife 10 can include an alternate fastener assembly design which performs the same functions of connecting the first and second portions 20, 22 and enabling the user to adjust the position of the knife 18 with respect to the body 12 of the knife 10. Therefore, the present invention is not limited to the foregoing description but only to the scope and spirit of the appended claims.

What is claimed is:

1. A utility knife for retractably retaining a replaceable blade, the knife comprising:

a body having first and second portions and a major longitudinal dimension, the first and second portions each having a proximal end and a distal end, the proximal end of the first portion coupled to the proximal end of the second portion, the first and second portions defining a cavity for storing at least a portion of the blade;

first and second longitudinally extending blade adjustment slots being disposed between the proximal end and the distal end of the first and second portions, respectively;

at least two detents connected to the body; and a blade adjusting, knife retaining fastener mechanism extending through the first and second blade adjustment slots of the first and second portions, respectively, and coupled to the blade, the mechanism configured to releasably connect the distal ends of the first and second portions of the body, the mechanism configured to releasably engage at least one of the detents and to adjustably extend along the first and second blade adjustments slots, each engagement of the fastener mechanism to one of the stops defining a distinct position of the blade with respect to the body.

2. The utility knife of claim 1, further comprising a blade carrier disposed within the cavity of the body and having an opening for receiving the fastener mechanism.

3. The utility knife of claim 1, wherein at least five detents are formed into one of the first and second portions of the body enabling the blade to be positioned with respect to the body in a corresponding five discrete positions.

4. The utility knife of claim 1, wherein the fastener mechanism can be assembled and disassembled without the use of tools.

5. The utility knife of claim 1, wherein the fastener mechanism can be adjusted between detents disposed along one of the first and second blade adjustment slots of the body without the use of an external tool.

6. The utility knife of claim 1, wherein the fastener mechanism comprises a male component and a female component, and wherein the blade adjusting slot of one of the first and second portions is formed such that the fastener mechanism can be used to connect and disconnect the distal ends of the first and second portions of the body without the use of an external tool and with separating the male component and the female component of the fastener mechanism.

7. The utility knife of claim 1, wherein the cavity of the body is configured to store at least one additional blade.

8. The utility knife of claim 1, wherein the blade adjusting, knife retaining fastener mechanism comprises:

a sleeve having at least one outwardly extending projection, the sleeve configured to extend into one of the first and second blade adjustment slots, the at least one projection configured to engage at least one of the detents;

a knob;

a shaft connected to the knob at one end and configured to extend through the other of the first and second blade adjustment slots at an opposite end and to removably connect to the sleeve; and a biasing member disposed between the body and one of the sleeve and the knob.

9. The utility knife of claim 8, wherein the biasing member biases the sleeve against one of the detents to fix the position of the blade, and wherein the biasing member, when compressed, enables the projection of the sleeve to extend beyond the detent of the body and to move along the one of the first and second blade adjustment slots.

10. The utility knife of claim 8, wherein the biasing device includes a coil spring.

11. The utility knife of claim 8, wherein the sleeve includes internal threads and two projections and wherein the shaft includes external threads.

12. The utility knife of claim 8, further comprising a washer disposed between the biasing member and the body for facilitating the adjustability of the mechanism.

13. A utility knife for retractably retaining a replaceable blade, the knife comprising:

a body having first and second portions and a major longitudinal dimension, the first and second portions each having a proximal end, and a distal end, the proximal end of the first portion coupled to the proximal end of the second portion, the first and second portions defining a cavity for storing at least a portion of the blade;

first and second longitudinally extending blade adjustment slots being disposed between the proximal end and the distal end of the first and second portions, respectively;

locking means coupled to the body;

blade adjusting means extending through the first and second blade adjustment slots of the first and second portions, respectively, and coupled to the blade, the blade adjusting means configured to releasably engage the locking means to define at least two discrete positions of the blade with respect to the body, the blade adjusting means configured to releasably connect the distal ends of the first and second portions of the body.

14. The utility knife of claim 13, further comprising a blade carrier positioned within the cavity of the body and having an opening for receiving the blade adjustment means.

15. The utility knife of claim 13, wherein the stopping means comprises five detents formed into one of the first and second portions of the body enabling the blade to be positioned with respect to the body in five discrete respective positions.

16. The utility knife of claim 13, wherein the blade adjusting means comprises:

a sleeve having at least one outwardly extending projection, the sleeve configured to extend into one of the first and second blade adjustment slots, the at least one projection configured to engage the stopping means;

a knob;

a shaft connected to the knob at one end and configured to extend through the other of the first and second blade adjustment slots at an opposite end and to removably connect to the sleeve; and a biasing member disposed between the body and one of the sleeve and the knob.

17. The utility knife of claim 13, wherein the cavity of the body is configured to store at least one additional blade.

18. The utility knife of claim 13, wherein the distal ends of the first and second portions form a blade opening through which the blade can be extended and retracted.

19. A utility knife adapted to enable a user to extend and retract a replaceable blade from the knife, the knife comprising:

first and second portions each having a first end and an open second end, the first end of the first portion pivotally coupled to the first end of the second portion, the first and second portions forming an internal cavity;

first and second blade adjusting slots being disposed between the first and second ends of the first and second portions, respectively;

a blade carrier disposed within the cavity, the blade carrier adapted to retain the blade and to move along the cavity between the open and closed ends of the first and second portions;

at least three detents connected to one of the first and second portions; and an adjustable fastener coupling the open second ends of the first and second portions and extending through the first and second blade adjusting slots of the first and second portions, respectively, the adjustable fastener configured to releasably engage at least one of the detents to define at least three discrete positions of the blade with respect to the body, the adjustable fastener configured to enable the user to connect the second ends of the first and second portions without the use of tools and to enable the user to adjustably position the blade with respect to the body in at least three discrete positions without the use of tools.

20. The utility knife of claim 19 wherein five detents are formed to one of the first and second portions adjacent to one of the first and second blade adjusting slots of the one of the first and second portions.

* * * * *